US005909874A

United States Patent [19]

Daniel et al.

[11] Patent Number: 5,909,874

[45] Date of Patent: Jun. 8, 1999

[54] ICOSAHEDRON DECIMAL DICE

[76] Inventors: Maurice Daniel, 3115 King St., Alexandria, Va. 22302; David J. Pristash, 12124 Parkview Rd., Brecksville, Ohio 44141; Michael D. Miller, 9650 Jackson Rd., Mentor, Ohio 44060

[21] Appl. No.: 08/909,094

[22] Filed: Aug. 12, 1997

Related U.S. Application Data

[63] Continuation-in-part of application No. 08/696,625, Aug. 14, 1996, abandoned.

[51] Int. Cl.[6] ..... A63F 9/04

[52] U.S. Cl. ..... 273/146; 273/274

[58] Field of Search ..... 273/146, 274, 273/268

[56] References Cited

U.S. PATENT DOCUMENTS

| | | | |
|---|---|---|---|
| D. 283,632 | 4/1986 | Moore | 273/146 |
| 809,293 | 1/1906 | Friedenthal | 273/146 |
| 1,525,023 | 2/1925 | Brown | 273/146 |
| 3,208,754 | 9/1965 | Sieve | 273/146 |
| 4,239,226 | 12/1980 | Palmer | 273/146 |
| 4,497,487 | 2/1985 | Crippen | 273/146 |
| 4,524,975 | 6/1985 | Caughie et al. | 273/146 |
| 4,632,397 | 12/1986 | Rivkin | 273/146 |
| 4,678,190 | 7/1987 | Dery | 273/146 |
| 4,735,419 | 4/1988 | Koca | 273/146 |
| 4,892,319 | 1/1990 | Johnson, II | 273/146 |
| 4,989,874 | 2/1991 | Freitas | 273/146 |
| 5,199,709 | 4/1993 | Lumpp, Jr. et al. | 273/146 |
| 5,224,708 | 7/1993 | Gathman et al. | 273/146 |

FOREIGN PATENT DOCUMENTS

| | | | |
|---|---|---|---|
| 621488 | 5/1927 | France | 273/146 |
| 2437853 | 6/1980 | France | 273/146 |
| 2528320 | 6/1982 | France | 273/146 |
| 207334 | 2/1984 | Germany | 273/146 |
| WO 83/0377 | 11/1983 | WIPO | 273/146 |
| WO 93/12848 | 7/1993 | WIPO | 273/146 |

OTHER PUBLICATIONS

*Playthings*, "Hobby Showcase", see Gamescience Rolls 20 Plus Dice, 1982, p. 72.

*Primary Examiner*—William M. Pierce

*Attorney, Agent, or Firm*—Sixbey, Friedman, Leedom & Ferguson; Daniel W. Sixbey

[57] ABSTRACT

A die of uniformly distributed material comprising a plurality of faces having a triangular shape and a plurality of numbers imprinted on the die. Each of the plurality of numbers imprinted on the die appear on a separate face, wherein each number appears on at least twice on the die. The dice are capable of generating random numbers, including negative and positive numbers, for use with board games, lotteries, stock market determinations, scientific work and other applications where random numbers are needed. For more complex random number generation, the system includes at least two dice having a distinct color and at least twenty faces, and a pattern of numbers imprinted on each dice, each number of the pattern appearing on a separate face of the dice, wherein the numbers have a different color than the dice.

27 Claims, 15 Drawing Sheets

ICOSAHEDRON DECIMAL DICE

This application is a continuation-in-part of Ser. No. 08/696,625 filed Aug. 14, 1996, abandoned.

TECHNICAL FIELD OF THE INVENTION

This invention is generally directed to the field of generating random numbers and more particularly to dice capable of producing a wide broad of random numbers for a variety of applications.

BACKGROUND

Many games include a set of dice to generate random numbers. The random numbers are then used to determine the next play. Many games of chance, such as Craps, use dice to determine a win or loss of money or chips. Ideally the dice are shaken in the player's hand, or in a special cup, and thrown on a felt surface against a wall. The felt surface helps to ensure that the dice will be caught by the surface and tumble rather than slide. The impact against the wall adds a further spin to the dice, thus adding to the randomizing process. In practice not all of these conditions are always met, but dice still provide a reasonably good method of providing a random number. Other methods of generating random numbers exist such as computers, wheels with pointers, etc.; but none are as simple and inexpensive as dice which can be carried in the pocket or purse and used almost anywhere.

Conventional dice consist of a small cube of plastic with the six sides successively numbered from one to six. The numbering of the sides usually takes the form of black, white or colored dots embossed in sides of the dice; but sometimes arabic number characters are used. In professional dice used at gambling tables, great pains are taken to ensure that the dice are balanced so as to have an exactly equal chance of rolling any of the six numbers.

The problem with conventional dice is that the numbers they generate are limited to multiples of six; i.e. one die can be thrown to generate the numbers from one to six, two dice can be thrown to generate the numbers one to twelve, etc. Consequently, it would be awkward to use conventional dice to generate random numbers from zero to nine, or from 0 to 99, or for higher numbers of decimal digits. Most board games, like Monopoly, avoid this problem by designing their games to use the roll of two dice to generate the numbers from 1 to 12.

This limitation of conventional dice eliminates the possibility of designing more sophisticated games that take the advantage of being able to generate random decimal numbers. For example, our money system is based on the decimal number system; the inventors have recognized that dice capable of generating decimal numbers could directly specify the amount of a bet in a game of chance, or in a board game. Games could be devised which use decimal dice to specify the price of stocks, properties, or other gaming objects in a board game.

The inventors have further recognized that there is a need for dice that would provide a means for generating random lottery numbers. Lotteries usually require the players to select several numbers between one and some upper limit number; for example, Virginia Pick 6 Lotto players must pick six numbers between 1 and 44, the Ohio Super Lotto requires players to pick six numbers between 1 and 47. Dice able to generate decimal numbers could be used to play any of these lotteries. These decimal dice would be thrown for each required number; numbers that are out of range or repeated would simply be thrown out and a new roll would be made until a valid number was thrown. Lottery numbers can of course be chosen by a wide variety of methods; in fact, most numbers are probably chosen out of the players head, such as the selection of numbers of important dates or from numbers encountered in daily experience. But numbers chosen from one's head lack a random quality, and the same numbers get played over and over again with no results. Random numbers chosen by the lottery computer fail to give the player a sense of control over the process of playing the game. Other mechanical methods of choosing random numbers are generally awkward, and most of them are not very portable. Dice on the other hand can be carried in one's pocket or purse and played anywhere. Moreover, dice also give players a direct feeling of control.

Different types of dice that attempt to improve upon conventional dice may be found in U.S. Pat. Nos. Des. 283,632 to Moore and 809,293 to Friedenthal which comprise ten faces with a number printed on each face. Although these die include more numbers and faces than conventional die, the designs and ability to create random numbers is still limited.

An improvement on the above-noted designs may be found in U.S. Pat. Nos. 3,208,754 to Sieve and 4,497,487 to Crippen which disclose icosahedron die having a plurality of numbers printed thereon. The Sieve design has a single digit printed on each face and is numbered from 1 to 20. The Crippen design includes two icosahedron dice with one die having numbers representing ten (10) odd numbers and ten (10) even numbers from 1 to 40 and the other die having numbers representing the remaining twenty (20) numbers from 1 to 40. The above dice patterns, however, are still limited in the variety of applications in which they may be used due to the numbering patterns and color schemes.

Further dice found in U.S. Pat. Nos. 4,735,419 to Koca, 4,892,319 to H Johnson II and 5,224,708 to Gathman also disclose various patterns of indicia printed on the faces of an icosahedron shaped dice. These pattern are similarly limited in application as those discussed above. In particular, the Koca and Johnson II dice are designed for use with a word game. The Gathman dice have playing card designed printed thereon and thus, are limited to a gambling application.

In view of the foregoing, the inventor have recognized a need for dice that are able to generate decimal numbers, such that, a user could produce a wide range of random numbers for a myriad of applications. In addition there is a need for an improved dice having a numbering system based on the number ten to provide a greater variety of generated random numbers.

SUMMARY OF THE INVENTION

It is therefore an object of the present invention to provide a simple method of generating random numbers in the decimal system for use in board games, generating lottery numbers, in scientific work where random numbers are needed, and in other applications.

It is another object of the present invention to demonstrate a pattern of imprinting numbers on the sides of an icosahedron solid to form a decimal die that only includes the digits from "0" to "9".

It is a further object of the present invention to show that each of the digits on the dice has equal probability of appearing on the top side of the icosahedron die following a normal roll of the die.

It is yet another object of the present invention to demonstrate methods of coloring the body of the die and the numbers which appear on the faces of the die to allow for the possibility of rolling negative or positive numbers on the same die in a single roll of the die.

It is also an object of the present invention to provide decimal dice which allows numbers within any whole number range limit to be rolled with equal probability.

It is a further object of the present invention to provide a method of rolling the number "0", which can be of great value in certain board games and games of chance.

These and other objects of the present invention are achieved by a die of uniformly distributed material comprising a plurality of faces having a triangular shape and a plurality of numbers imprinted on the die. Each of the plurality of numbers imprinted on the die appear on a separate face, wherein each number appears on at least twice on the die. The dice are capable of generating random numbers, including negative and positive numbers, for use with board games, lotteries, stock market determinations, scientific work and other applications where random numbers are needed. For more complex random number generation, the system includes at least two dice having a distinct color and at least twenty faces, and a pattern of numbers imprinted on each dice, each number of the pattern appearing on a separate face of the dice, wherein the numbers have a different color than the dice.

DETAILED DESCRIPTION OF THE PREFERRED EMBODIMENTS

Figure 1:
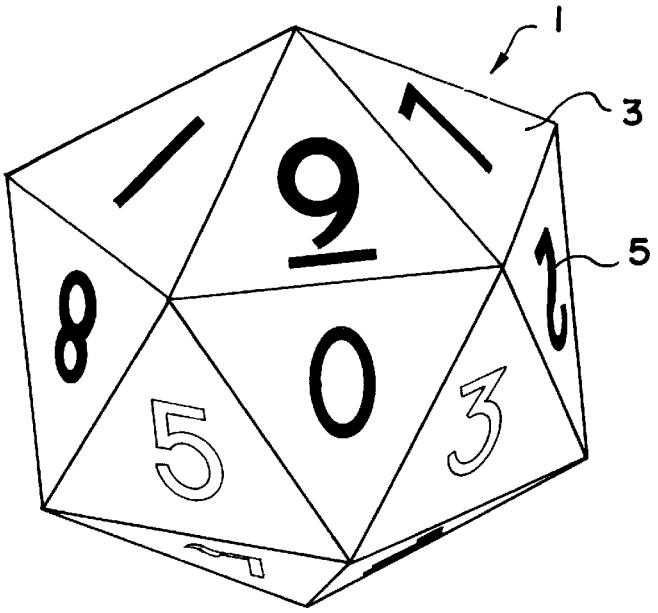
FIG. 1 shows a three-dimensional perspective view of an Icosahedron Decimal Die (IDD) in accordance with the preferred embodiment of this invention.

Referring to the figures of the present invention, FIG. 1 illustrates an icosahedron decimal die (IDD) 1 made of solid or hollow material such as plastic molded in the geometric shape of an icosahedron which has twenty triangular sides 3. In the preferred embodiment, each of the 20 triangular sides 3 of IDlD 1 are imprinted with a single numerical Arabic digit 5 in the range from 0 to 9. Each digit 5 within the range appears on two different sides of IDD 1. When IDD 1 is rolled, this numbering pattern gives each digit 5 in the range from 0 to 9 an equal probability of coming to rest on the top face of the die. The digits 5 are painted in two different colors. For example, in the preferred embodiment, if white plastic is used for the body of the die, then one set of digits forming the set from 0 to 9 would be colored black, and the other set of digits would be colored red. The digits are arranged on the die in a symmetrical fashion, as described later in the text. In FIG. 1 one set of numbers from 0 to 9 is shown as black characters and the other set of numbers is shown as black outlined characters. In the preferred embodiment the die would have one of the color patterns listed in Table 1 below.

Figure 2:
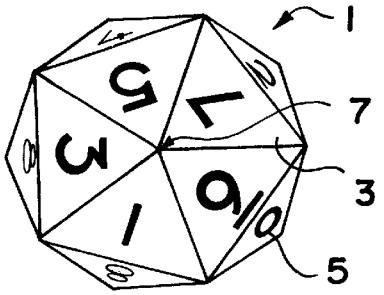
FIG. 2 shows a top view of the IDD in which the central vertex is composed of five triangles having only odd numbers in sequence from 1 to 9.
Figure 3:
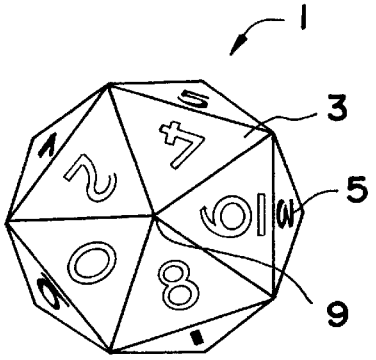
FIG. 3 shows a bottom view of the IDD in which the central vertex is composed of five triangles having only even numbers in sequence from 0 to 8.
Figure 4:
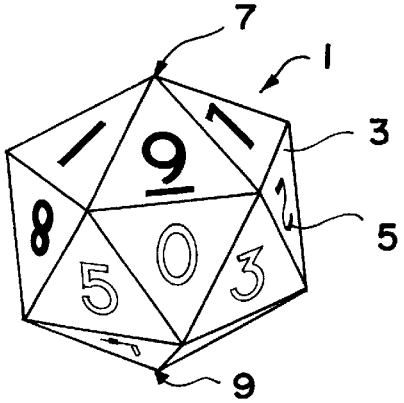
FIG. 4 shows a side view of the decimal die having the vertex with all odd numbers pointing up and the vertex with even numbers pointing down.
Figure 5:
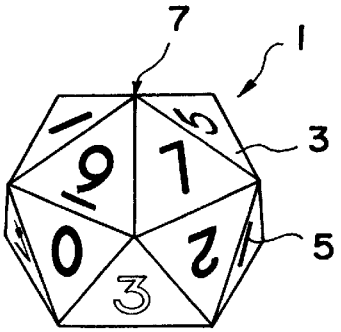
FIG. 5 shows a side view of a decimal dice having one face lying flat with the horizonal as it would appear when lying on a table top or other flat surface.

FIGS. 2 through 5 illustrate different views of the decimal die illustrated in FIG. 1. Specifically, FIG. 2 illustrates a top view of IDD 1 in which the central vertex is composed of five triangles having only odd numbers in sequence form 1 to 9. The central vertex of IDD 1 is the point at which five lines converge on the die to form a face showing at least five digits. FIG. 3 shows a bottom view of IDD 1 in which the central vertex is composed of five triangles having only even numbers in sequence from 0 to 8. FIG. 4 shows a side view of IDD 1 having a vertex with all odd numbers pointing up and the vertex with even numbers pointing down. FIG. 5 shows a side view of a IDD 1 having one face lying flat as it would appear when lying on a table top or other flat surface.

In the preferred embodiment, each side of each triangle of the decimal die would measure ¾ inch long, making the die about twice the over-all diameter of a conventional die. This size allows the numbers to be easily read at a distance while still allowing two or three decimal dice to easily fit in the hand of an adult. This larger size would also make it more difficult for a small child to get the decimal die lodged in his throat.

Figure 6:
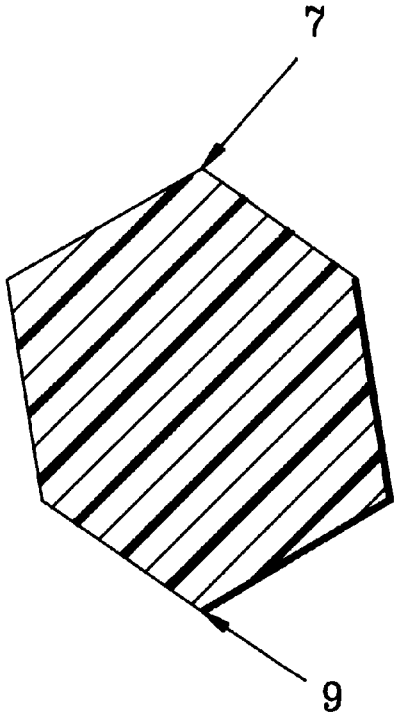
FIG. 6 shows a cross-sectional view of a decimal die orientated so that one vertex is up and the opposite vertex is pointed down.

FIG. 6 illustrates a cross-sectional view of IDD 1 orientated so that one vertex is up and the opposite vertex is pointed down. The orientation of this drawing is similar to FIG. 4 except that it has been rotated so that two of the edges fall exactly on the cross-sectional cut. In the preferred embodiment, the height of IDD 1 measured from the top central vertex to the bottom central vertex would be approximately 1.906 inches. One skilled in the art should recognize that the dimensions of IDD 1 may vary depending on the desired size of the die. A user may wish to have a die larger or smaller than that discussed in reference to the preferred embodiment.

Figure 7:
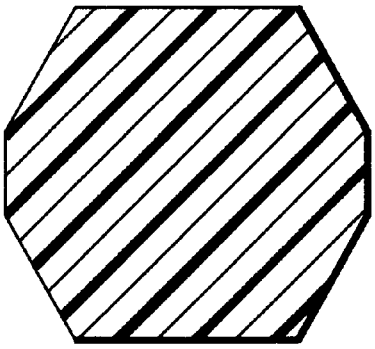
FIG. 7 shows a cross-sectional view of a decimal die orientated with one face lying flat with the horizonal similar to the die shown in FIG. 5 except that it has been rotated so that two of the edges fall exactly on the cross-sectional cut.

A cross-sectional view of IDD 1 having one face lying flat with the horizontal similar to the die shown in FIG. 5 is illustrated in FIG. 7. The view of FIG. 7 differs from FIG. 5, in that, it has been rotated so that two of the edges fall exactly on the cross-sectional cut.

If will be apparent from FIGS. 6 and 7 that the triangular sides 3 of the decimal die 1 form flat faces which are arranged such that each face is spaced from a substantially parallel opposite face. Also, as shown in FIGS. 2 and 3, the number or digit 5 imprinted on any face is in a set or group often preferably different from the set or group which includes the number on the opposite face. Thus the numbers on the top faces of the die are solid as shown in FIG. 2 while the numbers on the opposed bottom faces are outlined. The same is true for the opposite faces at the sides of the die which are not clearly shown.

Additionally, it is often desirable for the numbers on the opposite faces of the die to add to the same number which is the highest number on the die. Thus, in FIGS. 2–4, the sum of the numbers on each set of opposite faces would be nine. Thus, referring to FIGS. 2 and 3, the face with the "1" in FIG. 2 would be arranged opposite to the face with the "8" in FIG. 3, the face with the "9" in FIG. 2 would be opposite to the face with the "0" in FIG. 3, and so on. The same would be true of the opposite faces which form the sides of the die. The opposite faces would add to the highest number on the die which may be 1–9 as will be subsequently described. This functional relationships between opposite faces of a die, numbers in different groups on opposite faces, and/or numbers on opposite faces which all add to the same sum equal to the highest number on the die provides an equal probability that each of the digits on the die will appear on the top side following a normal roll. Also this relationship provides an equal probability that digits in each set or group will appear at the top after a normal roll.

Preferably, as illustrated in FIGS. 2–5 and in many subsequent Figures, the numbers and die faces are arranged so that the same numbers never share a common edge of adjacent triangular faces.

In the preferred embodiment, IDD 1 would be sold in sets of three dice. Each die would be colored in three different colors. The plastic body of the die would be one color; the first set of digits from 0 to 9 would be colored in a second color, and the second set of digits from 0 to 9 would be colored using a third color. In the preferred embodiment white, black, and red are chosen to color the body of the die and the two number sets, in any combination. The three different colors makes possible three different color combinations of dice, as described in Table 1 below which lists the three color combinations possible for icosahedron dice using the design pattern described herein.

TABLE 1

| | Body | First Number Set | Second Number Set |
|---|---|---|---|
| Die Number 1 | White | Red (−) | Black (+) |
| Die Number 2 | Red | Black (+) | White (−) |
| Die Number 3 | Black | White (+) | Red (−) |

Since there are three possible color combinations for IDD 1 using the preferred design pattern, a complete set of decimal dice shall be defined to mean a set of three dice, each colored differently in the manner listed in Table 1. This unique coloring scheme increases the versatility of the decimal dice of this invention. All three dice can be rolled simultaneously to yield a decimal number from 000 to 999; the color scheme determines the ordering of the digits in the number sequence. By our convention, the white die is always first, so whatever digit is displayed on the white die becomes the first digit in the sequence. In a similar manner, the red die is always counted second, and the black die is counted third. One roil of all three dice yields a completely random three digit number by counting the white die first, the red die second, and the black die third.

If it is desired to only obtain a random two digit decimal number, such as when playing most lottery games, only the white and red die are used in the roll. In this case the white die is counted first and the red die is used to display the second digit.

In some circumstances it is desired to obtain a random number within a range that is not an even power of ten. For example, most lottery games are played between particular number limits, i.e.: each of the six numbers played in the Ohio Super Lotto must fall between 1 and 47; in the Virginia Lottery each of the six numbers must fall between 1 and 44. In these, and similar types of number ranges, if the number rolled falls outside the desired range it is discounted and the dice are rolled again until the number rolled falls within the desired range. This procedure insures that when the number rolled does fall within the proper range, it will be a random number within that range.

In some games, a series of random numbers must be obtained in which no duplicate numbers are allowed. For example, many lottery games require the player to pick several numbers in which duplicates are not allowed. In this case the decimal dice are rolled for each number in the set. If the number rolled is a duplicate of a previous roll, the number is thrown out and the roll is repeated.

In some games it is desired to roll a negative or positive number. For example, Stock market games can be envisioned where the roll of the dice determine the increase or decrease in the price of a stock. In a board game, negative numbers could be used to allow movement in a backward direction along a path, while positive numbers determine forward movement. The two differently colored number sets on the decimal dice of this invention make it possible to assign negative numbers to on one set while assigning positive numbers to the other set. As a convention, we will establish the rule that black numbers are always positive and red numbers are always negative. Using this rule, the positive and negative numbers are shown on Table 1.

The decimal dice of this invention also has the possibility of throwing the number zero, which can not be thrown using conventional dice. The number zero could prove useful in many board games. Decimal dice which include the number zero could also be useful in generating random numbers for mathematical modeling and computer programming. In view of the foregoing, it is clear that virtually any requirements for the generation of a random number can be met using the decimal dice of this invention.

The color and digit patterns printed on IDD 1 may have many variations. These patterns are illustrated in the figures, beginning with FIG. 8, which show the surface of the icosahedron peeled off of the solid so that all 20 sides of the icosahedron appear flat on the page. If this pattern is cut out around its outside edges and folded along all inside edges it will form an icosahedron with the tops of the top row of triangles coming together to form the top vertex as shown in FIG. 2 and the bottoms of the bottom row of triangles coming together to form the bottom vertex as shown in FIG. 3. This pattern of triangles is used to show various possible numbering schemes for the decimal die of this invention. The two sets of numbers are in two colors; in these black and white drawings one color is indicated in black while the second color is indicated in gray. The numbers "6" and "9" have lines under them to indicate the bottom side of the number. For the purpose of this text the mirror image of this pattern, i.e. reversing the position of the numbers from left to right, shall be considered the same pattern, and therefore mirror images of patterns will not be shown or discussed in this disclosure.

Figure 8:
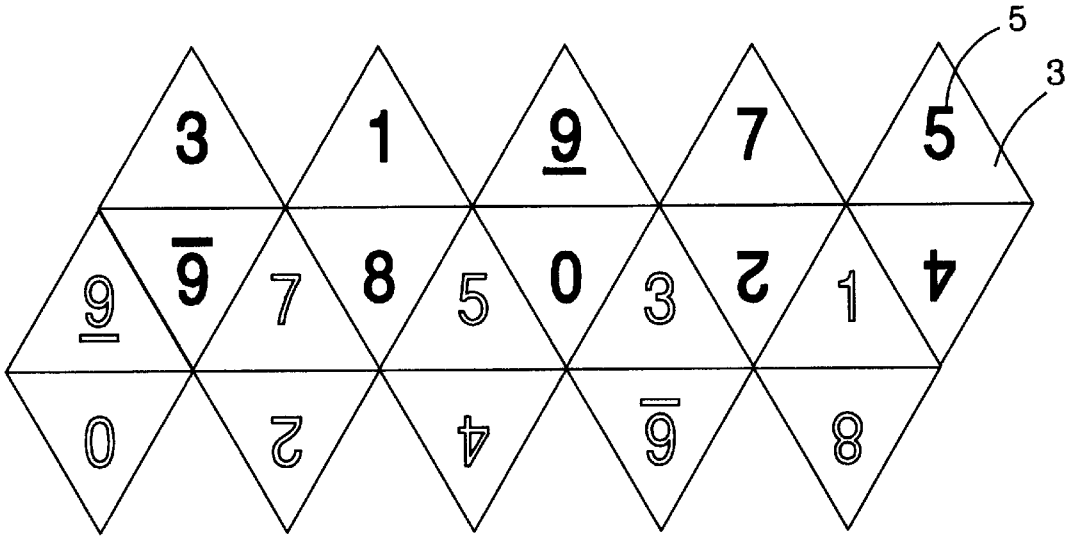
FIG. 8 shows a map view of an IDD baseline pattern in accordance with the preferred embodiment of the present invention shown in FIG. 1.

The preferred embodiment of IDD 1 employees a two color pattern of numbers, as shown in FIG. 8, where all of one color numbers appear on the top side of the die and the other color appear on the bottom side. This pattern is called the "IDD Baseline Pattern" which is the same pattern used on the dice shown in FIGS. 1 through 7. This pattern provides the greatest amount of symmetry within the color and number constraints of this invention. The numbers of all pairs of triangles add to nine. The numbers in any triangle row of four triangles always add to 18. The numbers in each of the four rows of triangles are arranged in numerical sequence. No number in the pattern is adjacent to the same number of the other color. Maximizing the symmetry of the pattern provides for the greatest randomizing of the numbers resulting from the throw of the die. By having all numbers of one color on one half of the die the preferred embodiment allows for easier printing of the two colors.

Alternatively, if the numbers are hand painted, or if more complex mechanisms are used to perform the printing of the numbers, many other patterns become feasible. A number of these possible two-color numbering patterns are shown in FIGS. 9 through 28 discussed in detail below. In these black and white drawings one set of numbers is shown in solid black and the other set is shown in black outline form. In the actual dice these two sets of numbers would be printed in two different colors, such as described above in Table 1. The body of the die would be of one color.

The intent of this invention is to distinguish one set of numbers from the other set to allow for forward or backward movement in various games or to allow negative or positive numbers on a single die. One method of distinguishing the numbers is to color each set differently as described above. Another alternative, using only one color of ink, would be to imprint one set as solid color and the second set as outline letters as shown in FIGS. 8 through 28. The outline verses solid color would serve to distinguish the two sets of numbers. Other variations using only one color of ink or paint could also serve this function. For example two different styles of numbering could be used such as "block" and "Roman" lettering, or standard and italic, or solid and dot-pattern lettering. The numbers could be replaced by dot patterns, similar to conventional six-sided dice, with one set of number indications consisting of from zero to nine solid dots and the second set consisting of small dot-sized circles. Alternatively, one set could be solid black and the other set could be gray, in which the gray is composed of a very fine pattern of black dots so that it appears gray when viewed from a distance.

The "one-ink-color" dice patterns described above do not allow the unique set of three color dice as described in Table 1 above. However, dice sets may consist of any number of dice, with each die colored differently, such as a four dice set described in Table 2 below, wherein the order in which the dice are to be read is indicated by the color of the die bodies. The negative numbers are indicated by outline characters.

TABLE 2

| | Body | First Number Set | Second Number Set |
|---|---|---|---|
| Die Number 1 | White | Solid Black (+) | Outline Black (−) |
| Die Number 2 | Red | Solid Black (+) | Outline Black (−) |
| Die Number 3 | Blue | Solid Black (+) | Outline Black (−) |
| Die Number 4 | Green | Solid Black (+) | Outline Black (−) |

Using the one-ink-color method, the number of dice in a set is limited only by the number of different colored dice that can be devised. All the colors in the spectrum could be used for the different dice in the set. Gold, silver, and other metallic colors could be used to color the various dice. Another useful variation would be to make all the dice in the set as shades of one color, such as from white to dark blue, as proposed in Table 3 below wherein the order the dice are to be read is indicated by the shade of color of the die bodies. White is first, followed by progressively darker shades of blue.

TABLE 3

| | Body | First Number Set | Second Number Set |
|---|---|---|---|
| Die Number 1 | White | Solid Black (+) | Outline Black (−) |
| Die Number 2 | Light Blue | Solid Black (+) | Outline Black (−) |
| Die Number 3 | Blue | Solid Black (+) | Outline Black (−) |
| Die Number 4 | Dark Blue | Solid Black (+) | Outline Black (−) |

The color method of Table 3 allows a "natural" method of ordering the dice after they are thrown, whereas the orderings of Tables 1 and 2 have to be memorized by the player, and thus require greater effort to use.

An alternative method of identifying the two sets of numbers on the die is to ink all the numbers in the same color and then color their backgrounds in two different colors. In this case the body of the die would be made in two different colored plastics, or other material. The different background colors could be achieved by making each die in several pieces of two different colors, and bonding the various pieces together to form the complete die. Alternatively, the die could be made of a single color material and half the faces painted in a different color, with all numbers painted in a different color. In this alternative embodiment, the baseline IDD Baseline Pattern of FIG. 10, all the other patterns shown in FIGS. 11 through 21, and other possibilities and variations could be fabricated using a single color of lettering with two different background colors.

Using this "Two-Background-Color" variation the baseline IDD Baseline Pattern of FIG. 10 could be reconfigured as shown in Table 4 below, which lists the three color combinations possible for icosahedron dice using the Baseline Pattern and Two-Background-Color method of distinguishing the two sets of numbers.

TABLE 4

| | All Numbers | Top Half of Body | Bottom Half of Body |
|---|---|---|---|
| Die Number 1 | Red | White (−) | Red (+) |
| Die Number 2 | Black | Black (+) | White (−) |
| Die Number 3 | White | Red (+) | Black (−) |

The preferred embodiment colored by the Two-Background-Color shown in Table 4 has all the advantages and disadvantages of the preferred embodiment colored by the methods of Table 1.

A variation of the Two-Background-Color method would be to use background patterns in place of solid colors. The sides of the die could be of the same color but have different patterns. Patterns could be formed of various mixtures of colored plastics and/or flakes of colored substance, metal, or pearlescent. Patterns could also be formed by embossing the surface of the plastic, spraying on a pattern, or using stick-on film, or by any other method commonly used to form patterns on surfaces.

Combinations of the above concepts could be used to add to the complexity of an icosahedron decimal dice set. A dice set could be made where each dice has two background colors and where the numbers are painted in two colors. In one variation, using the IDD Baseline Pattern, one set of numbers could have black numbers on a white background while the other set of numbers has white numbers imprinted on a black background arranged as shown in Table 5 below. Other number patterns are possible, but may be more difficult to manufacture. Table 5 shows one possible combination of two color backgrounds and two color number sets is shown for a set of three dice. This pattern assumes that the upper die body also contains the first number set ant the lower die body contains the second number set.

TABLE 5

| | Upper Body | Lower Body | First Number Set | Second Number Set |
|---|---|---|---|---|
| Die Number 1 | White | Black | Black (+) | White (−) |
| Die Number 2 | Black | Red | Red (−) | Black (+) |
| Die Number 3 | Red | White | White (+) | Red (−) |

A more complex die color method may involve four colors on a single die; two background colors and two different colors for the numbers. For example, each set of numbers could be given a different color while the background color of each number depends on weather it is odd or even.

A very complex decorative type of die could be designed involving the use of many colors for both the backgrounds and number colorations. Such a colorful die could be made several inches in diameter and used as a teaching aid for small children. This style of die could be made into a hollow "unbreakable" plastic icosahedron "ball" for pre-school children. This icosahedron "ball" die could be fabricated using the pattern illustrated in FIG. 20.

A dice set could employ the color variations described above in combination with the two color background concept to make a dice set having more than three dice per set. Applying this variation to the example displayed in Table 3 results in the useful variation displayed below in Table 6 where the order the dice are to be read as indicated by the shade of color of the upper die bodies. White is first, followed by progressively darker shades of blue. The bottom gray portion of each die serves to indicate negative numbers.

TABLE 6

| | Upper Body | Lower Body | First Number Set | Second Number Set |
|---|---|---|---|---|
| Die Number 1 | White (+) | Gray (−) | Solid Black | Solid Black |
| Die Number 2 | Light Blue (+) | Gray (−) | Solid Black | Solid Black |
| Die Number 3 | Blue (+) | Gray (−) | Solid Black | Solid Black |
| Die Number 4 | Dark Blue (+) | Gray (−) | Solid Black | Solid Black |

The above-noted coloring schemes may be used with a variety of digit patterns on the IDD to form many different embodiments of the present invention as will now be discussed below with reference to FIGS. 9 through 20.

Figure 9:
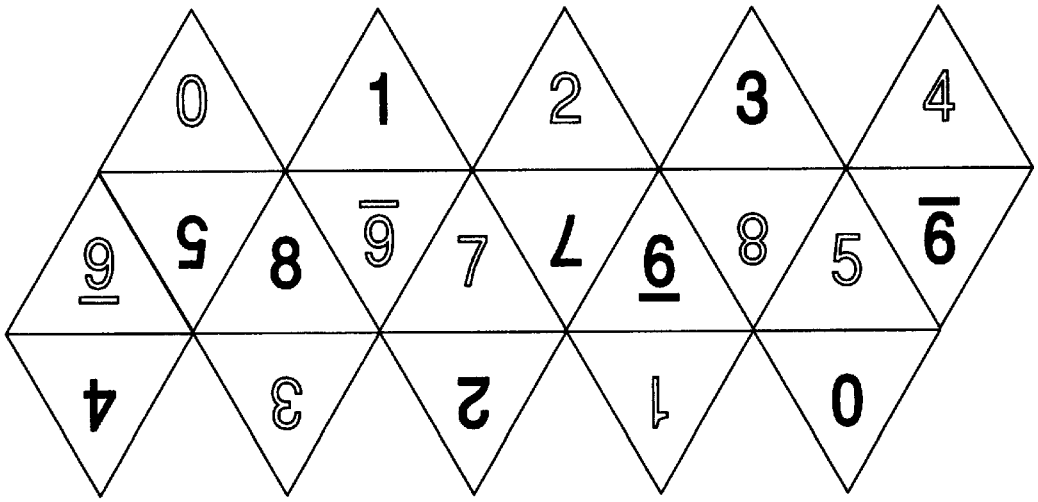
FIG. 9 shows a map view of an alternative color pattern as an alternative embodiment of the present invention.

FIG. 9 shows an "Alternate Color Pattern" having two numbers of one color and three numbers of the other color meeting at each vertex of a decimal dice. Each horizonal row of triangles is numbered in linear sequence.

Figure 10:
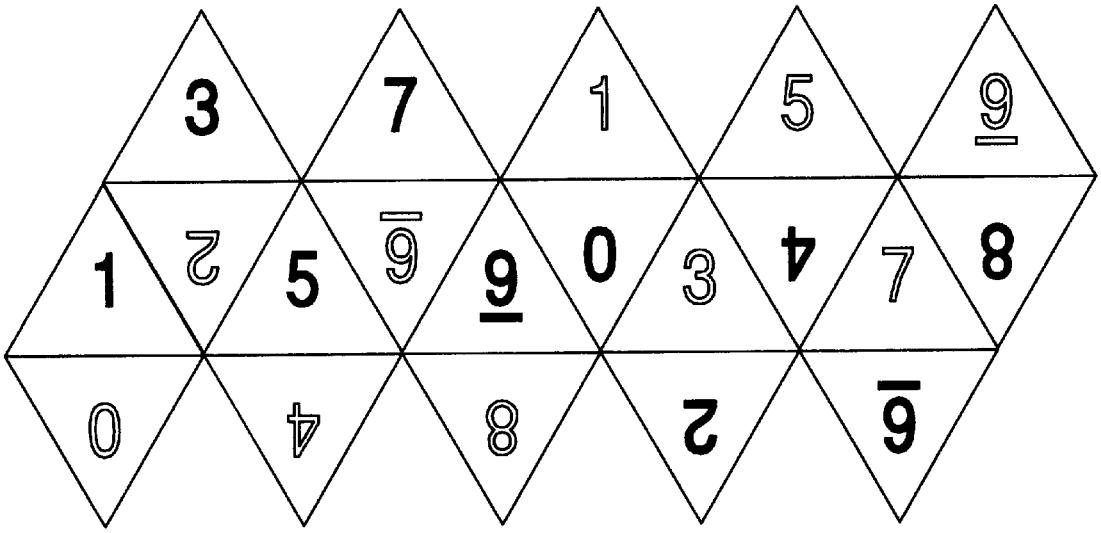
FIG. 10 shows a map view of a diagonal sequence pattern as an alternative embodiment of the present invention.

FIG. 10 shows a "Diagonal Sequence Pattern" having triangular sides numbered in strict numerical sequence on the diagonals starting with "0" on the lower left triangle up to "3" on the upper left triangle. For the next diagonal row numbering again begins on the lower triangle with the number "4" and ending with "7" at the top. Once the number "9" is reached numbering wraps around with the next number being "0". The colors of the numbers alternate from one to the other for each number in the diagonal sequences which results in having two numbers of one color and three numbers of the other color meeting at each vertex.

Figure 11:
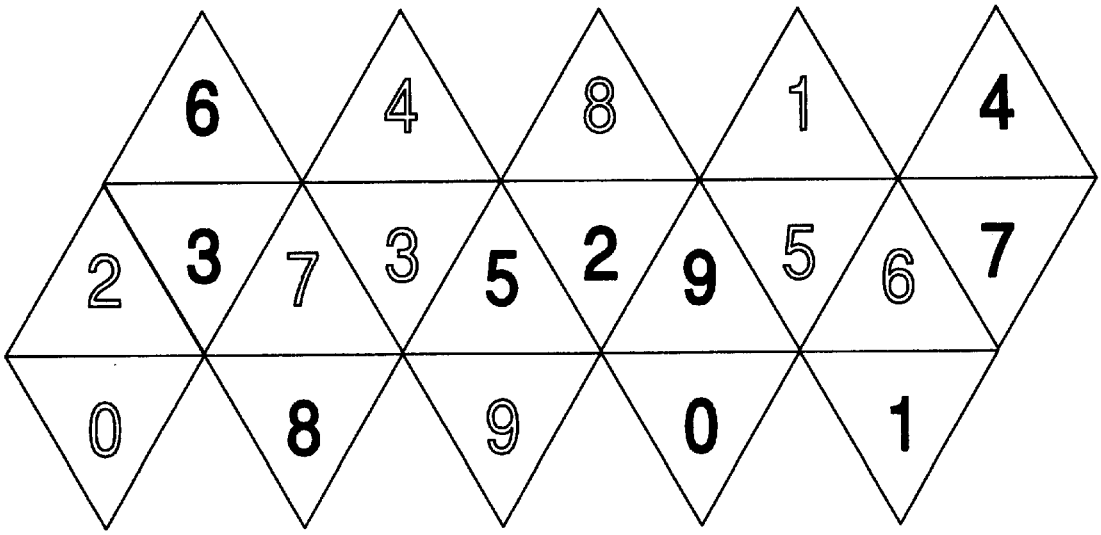
FIG. 11 shows a map view of a no-symmetry pattern as an alternative embodiment of the present invention.

FIG. 11 shows a "No Symmetry Pattern" wherein the numbers are randomized as much as possible within the constraint of having two numbers of one color and three numbers of the other color meeting at each vertex of a decimal dice. Also, the pattern is designed so that the same number does not appear on adjacent triangles.

Figure 12:
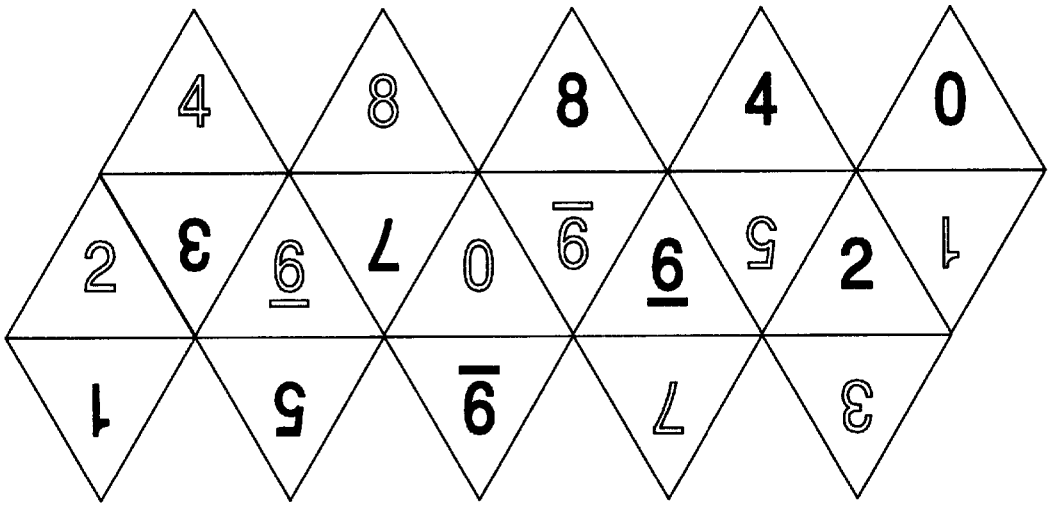
FIG. 12 shows a map view of a flipped diagonal symmetry pattern as an alternative embodiment of the present invention.

FIG. 12 shows a "Flipped Diagonal Symmetry Pattern" which is similar to the Diagonal Sequence Pattern described above. Numbering begins in the lower left corner with the number "1" and sequences up the diagonal row, and then continues with the lower triangle of the next diagonal row. The first sequence of numbers ends with the number gray "0" in the center row and then begins the next set with "9" and counts backwards from this point onwards until the end is reached with the number "0" on the upper right triangle. As before the colors of the numbers alternate from one to the other for each number in the diagonal sequences which results in having two numbers of one color and three numbers of the other color meeting at each vertex.

Figure 13:
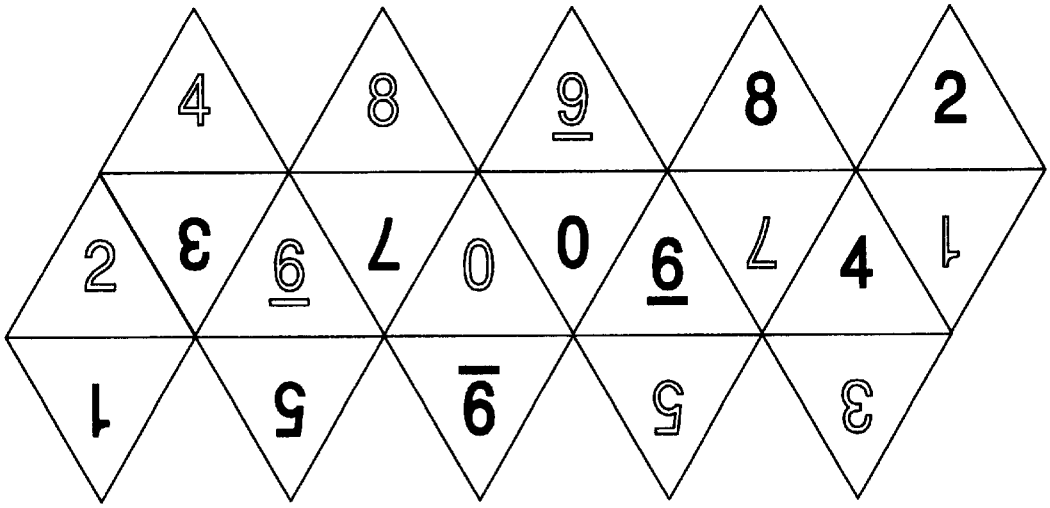
FIG. 13 shows a map view of a staggered diagonal pattern in accordance with an alternative embodiment of the present invention.
Figure 14:
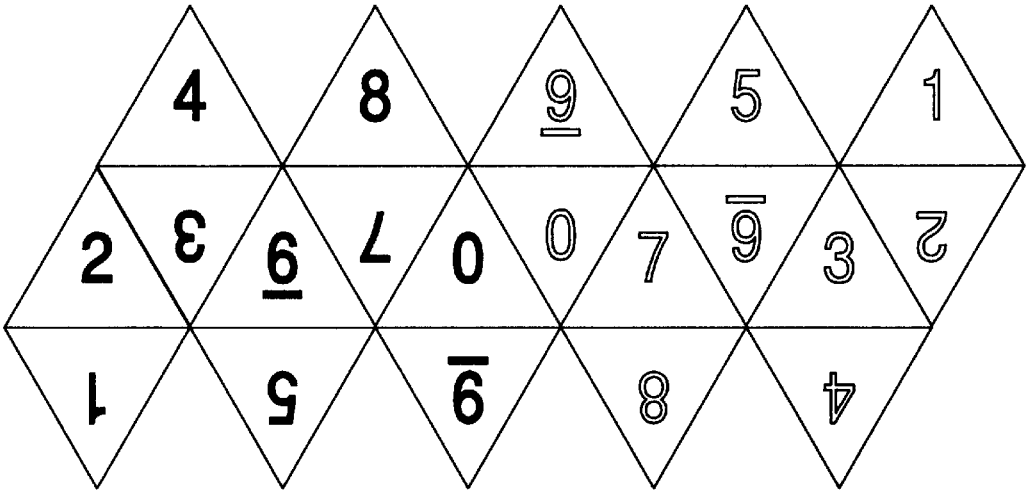
FIG. 14 shows a map view of a left-right symmetry pattern as an alternative embodiment of the present invention.

FIG. 13 shows a "Staggered Diagonal Pattern" which begins in a sequence similar to FIG. 14 for the first half the pattern. The sequence then runs backward: "0" and "9" for the remainder of the center diagonal. On the next diagonal the sequence begins on the bottom with "5" and ends with "8" at the top. On the last diagonal (on the right side) the pattern is randomized so that no two numbers are adjacent to one another when the pattern is wrapped around to meet with the diagonal row on the left.

FIG. 14 shows a "Left-Right Symmetry Pattern" which begins with "1" on the lower left triangle of the first diagonal row and continues in strict sequence to the numbers "9" and "0" and the center of the pattern. From there the pattern reverses itself beginning with "0" and then "9" and continuing to the number "1" at the top end of the right end diagonal row. The first half of the pattern is in one color and the second half is in the second color.

Figure 15:
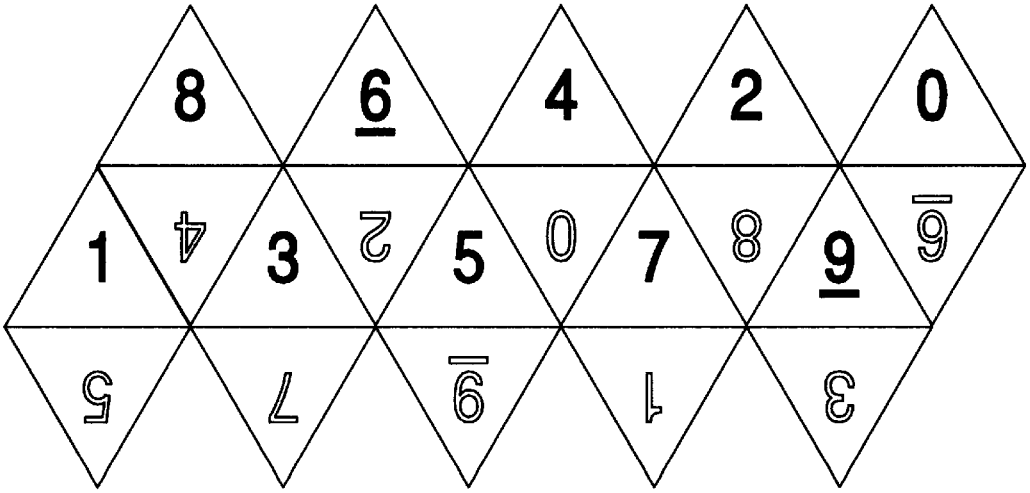
FIG. 15 shows a map view of a staggered even-on-top pattern as an alternative embodiment of the present invention.

FIG. 15 shows a "Staggered Even On Top Pattern" which is a variation of the IDD Baseline Pattern. Both the top and bottom rows are the same as the in FIG. 10 with the variation of having the middle two horizonal rows transposed. However, much of the symmetry of FIG. 10 is lost in this variation.

Figure 16:
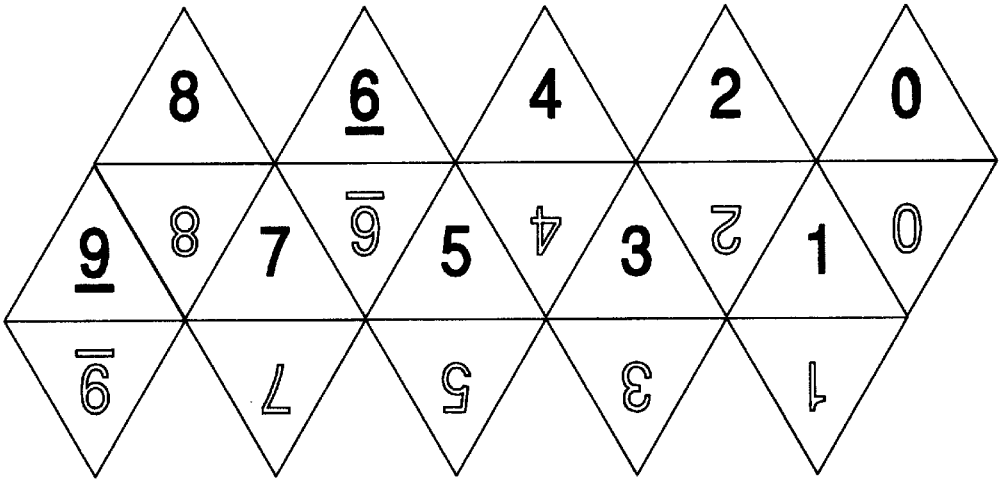
FIG. 16 shows a map view of an adjacent even-on-top pattern as an alternative embodiment of the present invention.

FIG. 16 shows a "Adjacent Even On Top Pattern" which places even numbers of one color in the top horizonal row of triangles, and places even numbers of the second color in the second horizonal row of triangles. The third horizonal row down is labeled with all odd numbers of the first color, and the last row is filled with odd numbers of the second color. All numbers of one value and color are paired with their corresponding number of the other color. In each row the numbers are ordered in sequence. Two numbers are repeated at every vertex.

The Adjacent Even On Top Pattern has as much symmetry as the preferred embodiment pattern. In the preferred embodiment pattern there is greater symmetry in the color pattern and in the Adjacent Even On Top Pattern there is greater symmetry in the number pattern. We believe that the IDD Baseline Pattern is the better choice for a die in all cases where rolling for a number is more important than rolling for a particular color. The IDD Baseline Pattern makes it much more difficult to roll for a specific number. However, the baseline die would be relatively easy to roll for a specific color. If the color of the number were used in a game to mean the gain or loss of points or money, then it would be important to make it difficult to row for a specific color, in which case the Adjacent Even On Top Pattern would be the best choice for the icosahedron decimal die.

Figure 17:
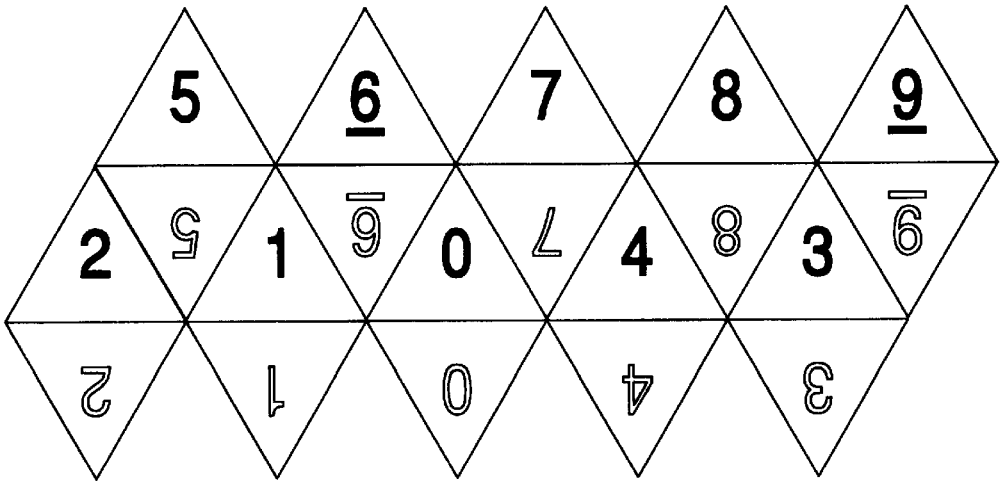
FIG. 17 shows a map view of a high on top and low on bottom pattern as an alternative embodiment of the present invention.

FIG. 17 shows a "High On Top And Low On Bottom Pattern" which has the high numbers from "5" to "9", all of one color, imprinted in sequence in the top horizonal row of triangles and again the high numbers of the second color are imprinted in the second row of triangles. The low numbers from "0" to "4" of the first color are imprinted in the third horizonal row and the low numbers of the second color are arranged in sequence in the bottom row of triangles. All numbers of one value and color are paired with their corresponding number of the other color.

The High On Top And Low On Bottom Pattern is also a very high symmetry pattern. This pattern would make it easy to roll for either a high or a low number. It would not be a good pattern to use in games where the value of the number is important, such as in games where the die is rolled to determine points, money, or position on a board game.

Figure 18:
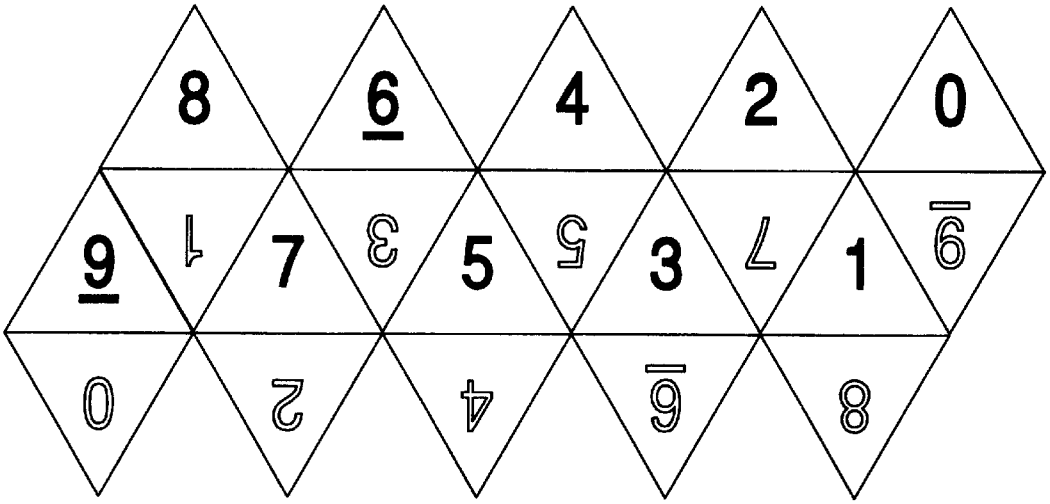
FIG. 18 shows a map view of an even on top and bottom pattern as an alternative embodiment of the present invention.

FIG. 18 shows an "Even On Top And Bottom Pattern" which has the even numbers of one color imprinted in sequence in the triangles comprising the top horizonal row of the pattern. The odd numbers of the second color fill in the triangles of the second horizonal row (from the top). The odd numbers of the first color fill in the triangles of the third horizonal row. The even numbers, of the second color, are imprinted in the bottom horizonal row of triangles. Each pair of odd and even triangles have the numbers add to the value nine.

Figure 19:
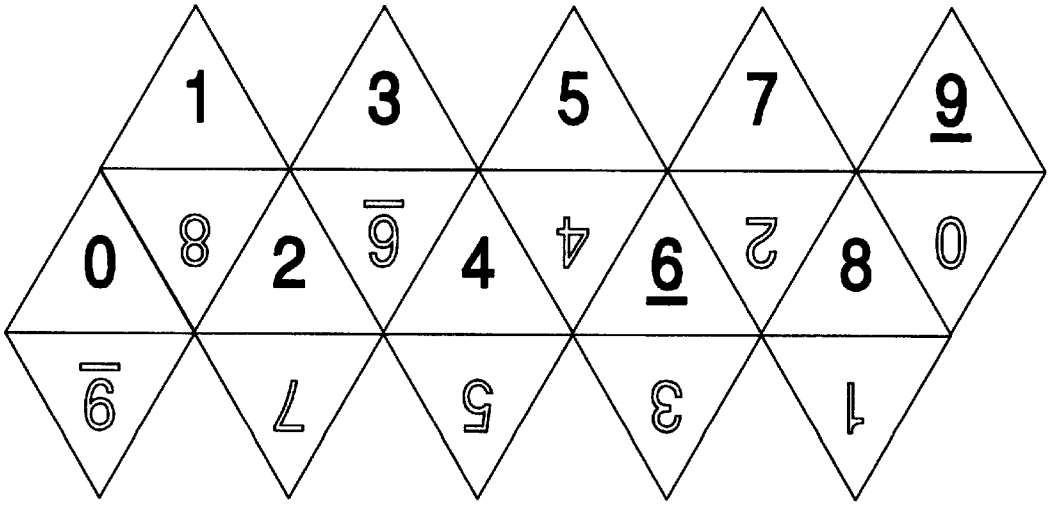
FIG. 19 shows a map view of an odd on top and bottom pattern as an alternative embodiment of the present invention.

FIG. 19 shows an "Odd On Top And Bottom Pattern" which is exactly the same as the Even On Top And Bottom Pattern of FIG. 18 with the position of the even and odd numbers reversed.

Both the Even On Top And Bottom Pattern and the Odd On Top And Bottom Pattern have high degrees of symmetry making them candidates for the preferred embodiment of this invention. They have the advantage of making it difficult to roll a high value or to roll a specific color. But they have the strange property of being either an odd dice or an even dice. If one of these two patterns was manufactured, then which one should be chosen? One choice precludes the other for no logical reason.

Figure 20:
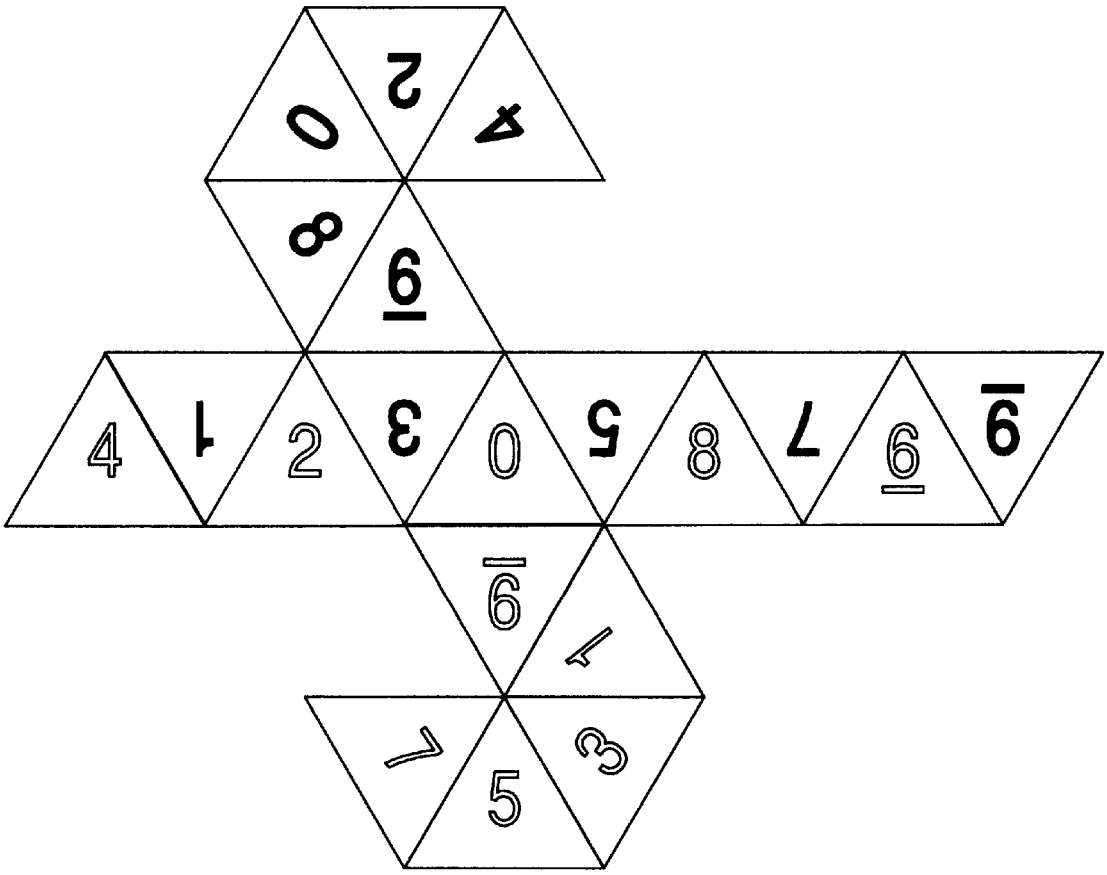
FIG. 20 shows a map view of an odd on top and bottom pattern as an alternative embodiment of the present invention.

FIG. 20 shows a "Baseline Pattern, Easy Construction Pattern" and a possible mechanical layout of a die during fabrication into a hollow die. The cut-out pattern is imprinted with the baseline pattern (or some other pattern) in two colors on a flat sheet as shown in the figure. Once painted the pattern would be cut and folded mechanically into the basic die shape. Once formed it would be welded sonicly to form a single hollow die.

In addition to above coloring schemes and digit patterns, various numerical schemes may be used in the present invention to create digit patterns for many different applications. These alternative numerical schemes will now be discussed in detail below.

The number 20 has the factors 1, 2, 4, 5, 10 and 20. The preferred embodiment of this invention makes use of the factor "10", noting that ten digits of symbols can appear twice on a twenty sides icosahedron. Previous inventions make use of the factor "20" to affix twenty different numbers or symbols on the sides of an icosahedron die. All possible symbol sets are shown in Table 7 below.

TABLE 7

| Factor | Number of symbols in set | Number of sets | Name of set |
|---|---|---|---|
| 1 | 1 | 20 | n/a |
| 2 | 2 | 10 | Binary |
| 4 | 4 | 5 | Quadratic |
| 5 | 5 | 4 | Pentad |
| 10 | 10 | 2 | Decimal |
| 20 | 20 | 1 | — |

The factor "1" leads to all sides having the same symbol, which is not useful as a gaming die. The factors "10" and "20" are discussed above. This leaves the factors "2", "4", and "5" which can be used to produce useful gaming dice. These three types of dice are given the names: Binary Icosahedron Dice, Quadratic Icosahedron Dice, and Pentad Icosahedron Dice. In each of these three types of icosahedron dice the numbering patterns have a number of possible arrangements. For the purpose of a gaming die, only those arrangements that have a high degree of symmetry are of use for the reasons discussed above. Other possible patterns are discussed below:

Pented Icosahedron Dice

For game playing, the Pentad Icosahedron Dice provides a very useful number set. In particular, if the dice are being used to roll high stake lottery numbers, the Pentad Icosahedron Dice can be used to reduce the number of wasted rolls. High stake lotteries usually employ 5 or 6 two digit numbers per play. The numbers have different ranges depending on the lottery. Table 8 below gives the number ranges for several example state and regional lotteries.

TABLE 8

| State Lottery | Number of Two Digit Numbers | Number Range Low | Number Range High |
|---|---|---|---|
| Virginia | 6 | 1 | 44 |
| Maryland | 6 | 1 | 49 |
| Ohio | 6 | 1 | 47 |
| Ohio Buckeye Lottery | 5 | 1 | 37 |
| DC Quick Cash | 6 | 1 | 39 |
| DC Power Ball | 6 | 1 | 45 |
| Lotto America | 6 | 1 | 54 |

From Table 8 it is seen that in most lotteries the highest possible two-digit number is less than "50". If two Icosahedron Decimal Dice were used to roll the numbers, more than half the rolls would be out of range because they would be too high. Each time a number was rolled that was too high the game player would have to discard the roll and roll again. This would distract from the convenience of using Icosahedron Decimal Dice to roll lottery numbers.

An alternative would be to use a Pentad Icosahedron Dice, having the number range 0 to 4 in each set, as the first die in the two dice set. The first Pentad Icosahedron Die would roll a digit between 0 and 4, and the second Icosahedron Decimal Die would roll a digit between 0 and 9. For example, by using this pair of icosahedron dice to play the Virginia State Lottery, only the rolls of 00, 45, 46, 47, 48, and 49 would be out of playing range. The odds of rolling one of these out of range number combinations is only 6 out of fifty, or 12%, or approximately one in eight rolls would be out of range. This is far better than rolling two Icosahedron Decimal Dice, which would give 56 out of range number combinations, or 56%, or approximately 9 out of every 16 rolls are out of range.

Figure 21:
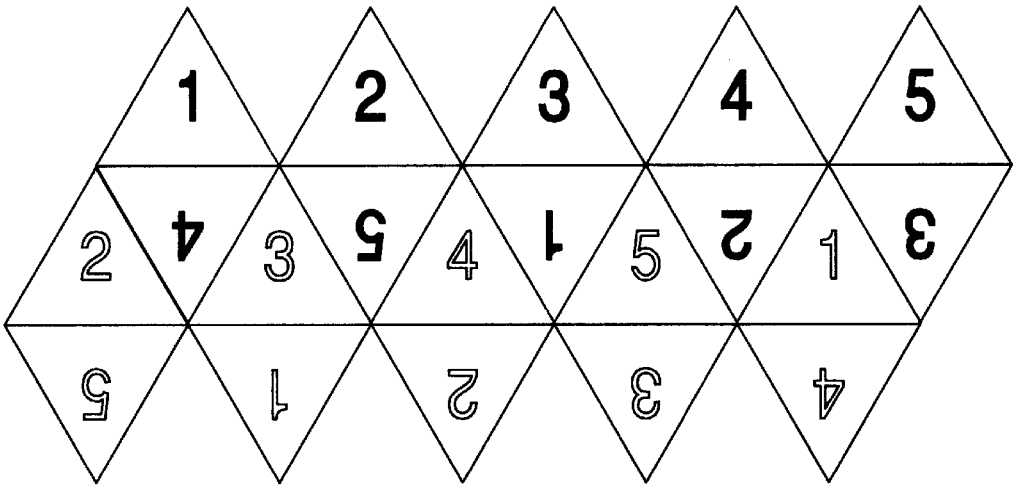
FIG. 21 shows a map view of a baseline 1–5 pattern as an alternative embodiment of the present invention.
Figure 22:
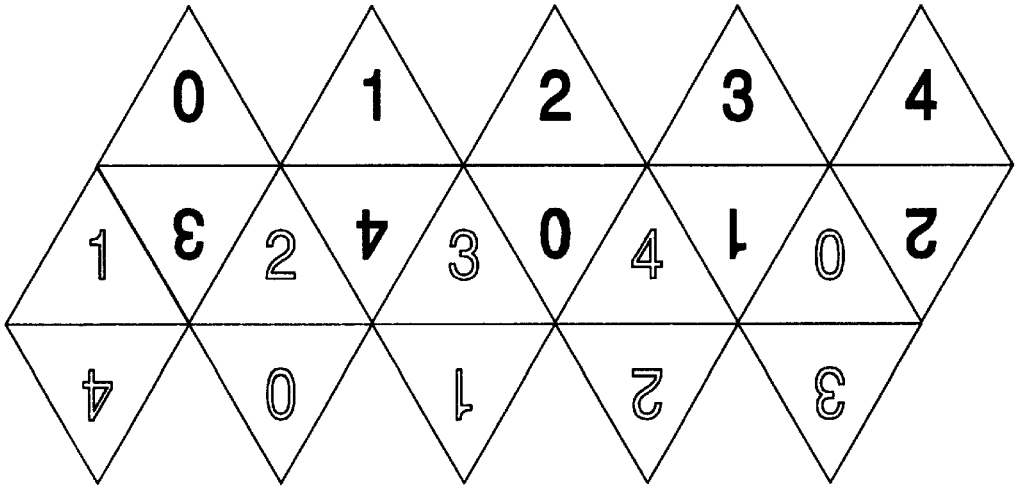
FIG. 22 shows a map view of a baseline 0–4 pattern as an alternative embodiment of the present invention.

A Pentad Icosahedron Die, with the number range of 1 to 5 or 0 to 4, allows a number of symmetrical number patterns on an IDD, as shown in FIGS. 21 and 22, respectively. In particular, FIG. 21 arranges one complete set of numbers from 1 to 5 in each row of triangles. The beginning of each number sequence is off-set from the previous number set so as to have complete number sequences meet at each vertex without duplication of numbers at each vertex. The two top rows of numbers (top half of die) are printed in one color and the bottom two rows of triangles are printed in a second color. It would be possible to print each row of triangles with a different color to yield a die having four number sets, each in a different color. This particular pattern is chosen as the baseline pattern for the 0-1 pattern because it offers the maximum possible symmetry using the 1 to 5 number sets.

The baseline 0 to 4 pattern illustrated in FIG. 22 is identical to the baseline 1–5 pattern, discussed above with respect to FIG. 21, except that each digit of the 1–5 pattern is decreased by one.

Figure 23:
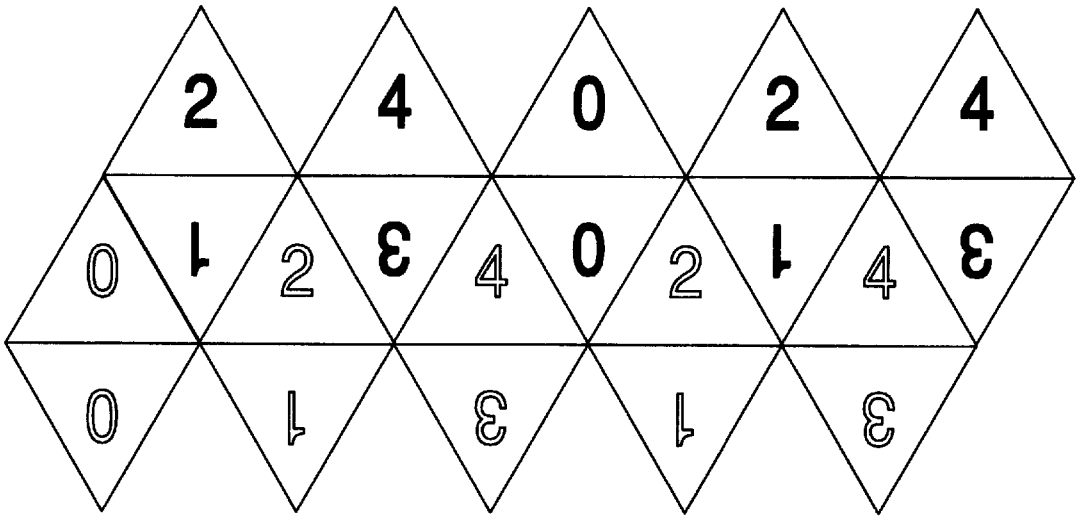
FIG. 23 shows a map view of a 0–4 odd/even separation pattern as an alternative embodiment of the present invention.

FIG. 23 illustrates a 0–4 Odd/Even Separation Pattern having the numbers arranged in rows, in which the first and third rows have even numbers plus zero, and the second and fourth rows have odd numbers plus zero. One number set occupies the top half of the die and the other number set occupies the bottom half of the die.

Figure 24:
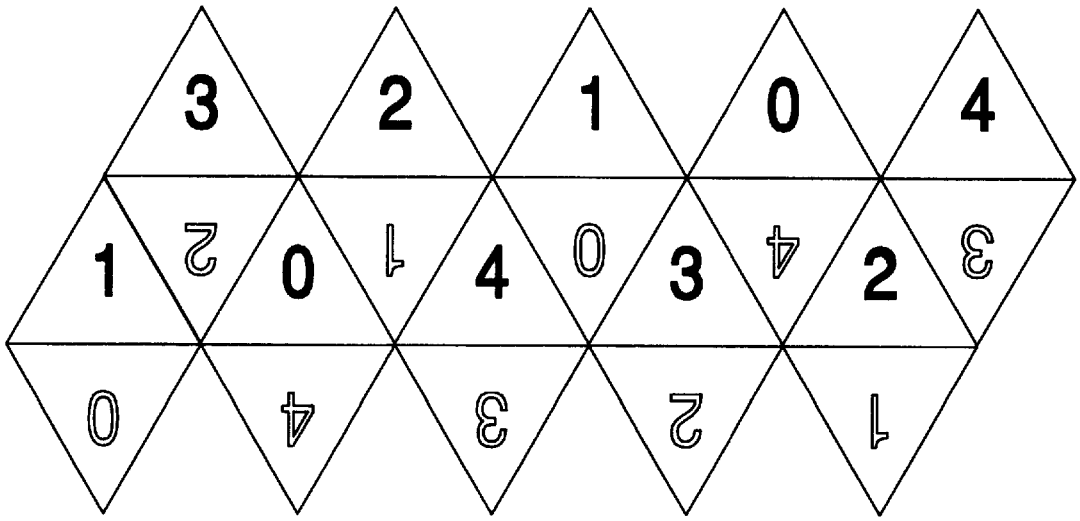
FIG. 24 shows a map view of a 0–4 linear with staggered color pattern as an alternative embodiment of the present invention.

FIG. 24 illustrates a 0–4 Linear with Staggered Color Pattern which begins numbering the sides in sequence along diagonal sets of triangles beginning with the lower left triangle in the pattern. From the upper triangle of the first 4-triangle diagonal set, the numbering continues in sequence with the lower triangle of the next diagonal. Every other digit is colored with the opposite color.

In some games it may be desirable to fabricate a Pentad Icosahedron Die with a number range of 1 to 5. The possible patterns for such 1–5 Pentad Icosahedron Dice would be the same as for the 0–4 dice with all numbers shifted up one digit.

Quadratic Icosahedron Dice

The Ohio Buckeye Lottery, the DC Quick Cash Lottery, (as shown in Table 8) and some lotteries from other states have ranges of play numbers less than the number "40". To generate random numbers for these lotteries it would be useful to have a range of from 0 to 3 on the first die of the roll. This could be accomplished using a Quadratic Icosahedron Die. As with the Pentad Icosahedron Die described in the previous section, the Quadratic Icosahedron Die would reduce the number of out of range throws of the dice in lotteries having play number ranges less than 40.

Figure 25:
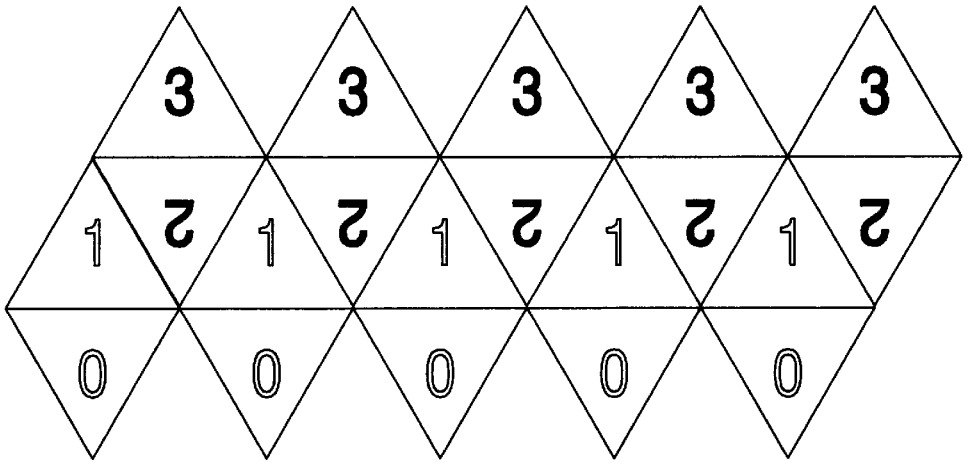
FIG. 25 shows a map view of a 0–3 linear baseline pattern as an alternative embodiment of the present invention.
Figure 26:
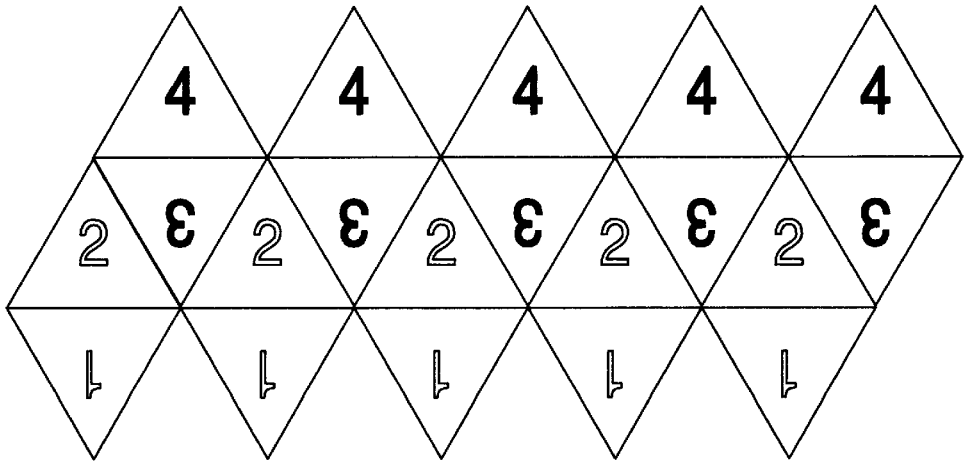
FIG. 26 shows a map view of a 1–4 linear baseline pattern as an alternative embodiment of the present invention.

A Quadratic Icosahedron Die, with the number range of 0 to 3 or 0–4, provides a number of symmetrical number patterns on an icosahedron, as shown in FIGS. 25–28. Specifically, FIGS. 25 and 26 show a linear baseline pattern arranged to have all the triangles in a single row printed with the same number. This arrangement is made possible because there are four rows of triangles and four numbers in the sequence. The top two rows are printed in one color and the bottom two rows are shown printed in a second color, but in this case the coloring pattern has no practical value other than to identify the top and bottom hemispheres of the die. A second color pattern could have been arranged whereby the even numbers could be printed in one color and the odd numbers could be printed in a second color. In this case the colors would be used to identify odd and even numbers. Another coloring possibility would be to print the number set in five different colors with each set of numbers printed in a different color. FIG. 25 is named the baseline pattern for the 0–3 numbering set because it maximizes the symmetry for the 0–3 number set. FIG. 26 is named the baseline pattern for the numbering 1–4 for these same reasons.

Figure 27:
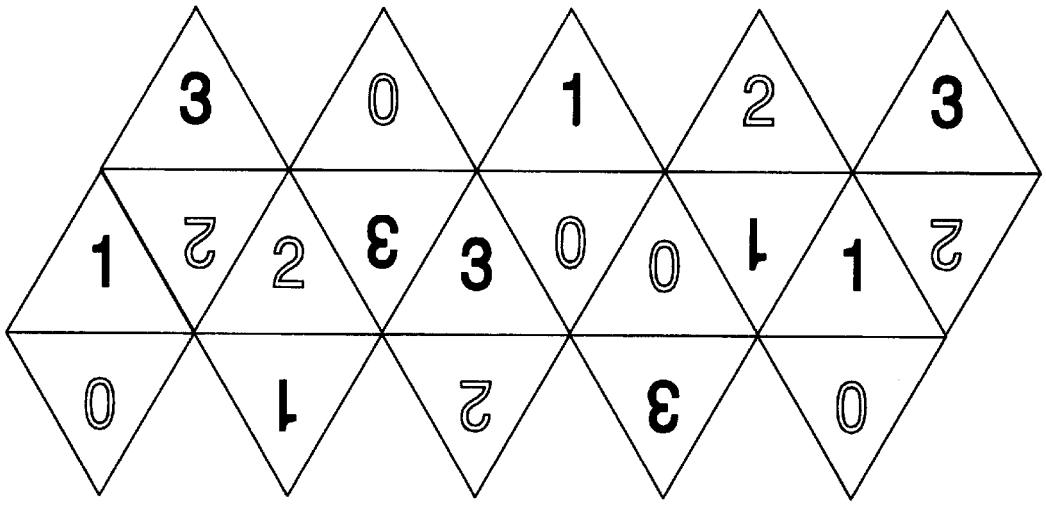
FIG. 27 shows a map view of a 0–3 1-character offset pattern as an alternative embodiment of the present invention.

A 0–3 1-Character Offset pattern is shown in FIG. 27 and has each 0 to 3 number set arranged along a four triangle diagonal. In this figure, the first set begins with the number "3" and has the sequence (3, 2, 1, 0). The next diagonal is offset by one and begins with "0" and has the sequence (0, 3, 2, 1). The third diagonal is again offset by one from the previous diagonal and has the sequence (1, 0, 3, 2). This arrangement is repeated for each diagonal ending with the last diagonal having the same sequence as the first. Each vertex has at least one repeated number meeting at the vertex and some vertex have two repeated numbers meeting at the vertex. In this pattern the even numbers are given one color and the odd numbers are given another color. The symmetry is not great in this pattern because the number four (four numbers in the set) does not match well with the geometric features of the icosahedron, i.e. the number of triangles at a vertex is five.

Figure 28:
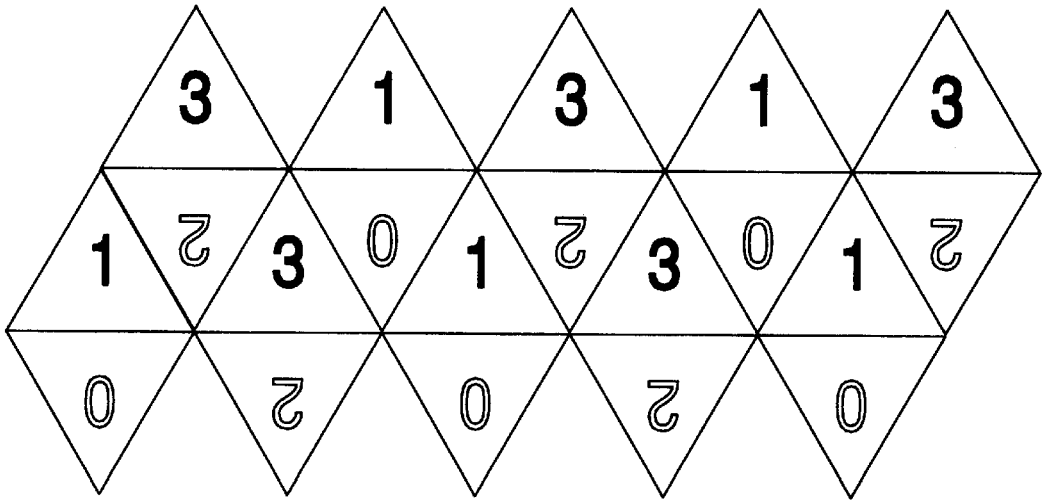
FIG. 28 shows a map view of a 0–3 2-character offset pattern as an alternative embodiment of the present invention.

In FIG. 28, the 0–3 2-character offset arrangement is a variation of the 1-character offset pattern. In this pattern, one number set is arranged along each diagonal row of triangles, the same as in the 0–3 1-Character Offset Pattern (3, 2, 1, 0) of FIG. 27; however, in the second diagonal row the pattern is advanced by two digits to yield (1, 0, 3, 2). The third row is again offset by two digits to yield the same pattern as the first diagonal row. The pattern is continued until the last diagonal row repeats the pattern of the first row. This pattern has more symmetry than the 1-Character Offset Pattern of FIG. 27. The top and bottom vertex have two repeating numbers each. Each vertex between the top and bottom have one repeating number, except for the first and last vertex. The even numbers are given one color and the odd numbers are given another color, which causes the top and bottom vertexes to have one color, and all the in-between vertexes to have mixed color patterns.

In all the above four digit number sets at least one number is repeated at each vertex of the icosahedron, making it difficult to produce highly symmetric four digit die patterns.

Binary Icosahedron Dice

There are many games where a simple binary choice is periodically required of the players, such as a "yes" or "no" answer, or a negative or positive choice, etc. This could be accomplished by the toss of a coin, but the icosahedron die, with a binary numbering pattern, provides a more eloquent gaming device to accomplish this random choosing of an alternative.

Figure 29:
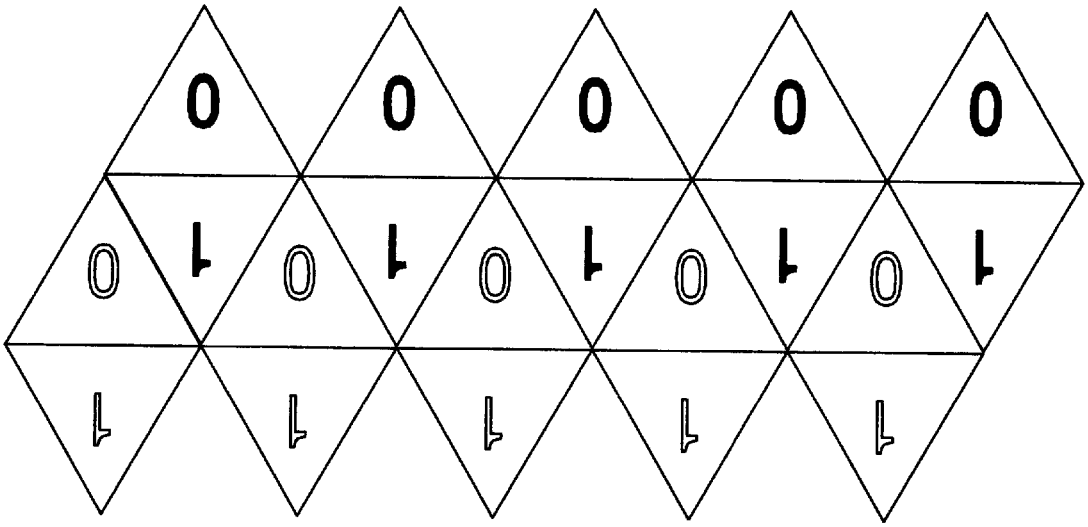
FIG. 29 shows a map view of a binary odd/even layered pattern as an alternative embodiment of the present invention.
Figure 30:
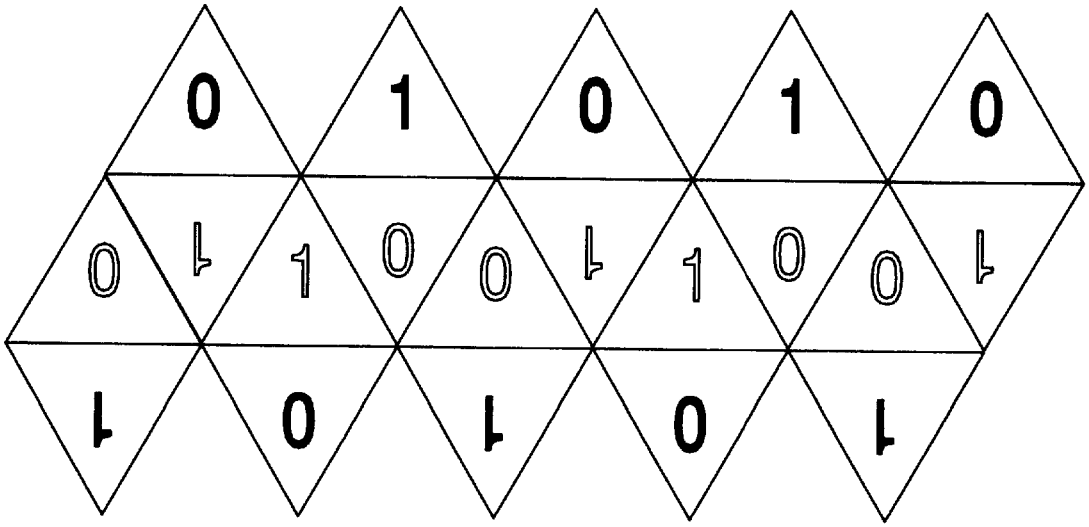
FIG. 30 shows a map view of a binary odd/even staggered pattern as an alternative embodiment of the present invention.

A Binary Icosahedron Die, with the number range 0 to 1, also allows a number of highly symmetric numbering patterns on its dies, such as shown in FIGS. 29 and 30. Specifically, FIG. 29 illustrates a Binary Odd-Even Layered arrangement having the two digit (0,1) pattern repeated ten times on the sides of the icosahedron die. A high degree of symmetry is achieved in this pattern by assigning a single digit to each horizonal row. The top two horizonal rows are assigned one color and the bottom two rows are assigned a second color. In this color arrangement one color could be used to represent negative numbers and the other color could represent positive numbers. A four color arrangement could be used whereby each horizonal row is assigned a different color. A five color arrangement could be used whereby each diagonal row is assigned a different color.

FIG. 30 displays a Binary Odd-Even Staggered pattern which arranges two consecutive sets of numbers along each diagonal. The ordering of the numbers are reversed in each following diagonal, causing a staggering of the numbers from one diagonal row to the next. The resulting pattern has considerable randomness: each vertex has two representations of one number and three representations of the other number. In this pattern the top and bottom horizonal row are printed in one color and the middle two horizonal rows are assigned a second color.

Further alternative embodiments of the present invention may include Binary, Octal and Hexagonal Icosahedron dice and Infant Educational dice which may be used for further applications as discussed below.

Computers operate using binary, octal, and/or hexagonal numbers. Computer programmers sometimes need to create random number data in binary, octal, or hexagonal formats; as for example, when performing Monte Carlo simulations. If only a small amount of random data is required, it could be generated by tossing especially designed icosahedron dice. A binary die for this purpose would be designed as described earlier.

An octal icosahedron die would have two sets of numbers in the range 0 to 7 with four positions on the die left blank to provide for the mismatch between the 16 numbers and the twenty sides of the icosahedron. The octal die could utilize any of the patterns described previously for the preferred embodiment, by simply replacing the numbers "8" and "9" with blanks.

A Hexagonal Icosahedron Die would have the hexagonal number set: 0, 1, 2, 3, 4, 5, 6, 7, 8, 9, A, B, C, D, E, and F, printed on the faces of the icosahedron die, with four sides left blank to provide for the mismatch between the 16 numbers and the twenty sides of the icosahedron. The Hexagonal Icosahedron Die could use the same patterns described previously for the preferred embodiment by adding eight to the second number set and again replacing the numbers "8" and "9" (in the original pattern) with blanks. In this case the hexagonal number set would only appear once on the icosahedron die.

With respect to infant educational dice, many toys are manufactured to teach infants the alphabet and the number set. In some cases dice are made with numbers printed on them to teach the number set, but ordinary cubic dice can only provide six unique number digits making them incomplete as a teaching tool. An Icosahedron Decimal Die, patterned as the preferred embodiment, and colored in bright colors would make an ideal teaching tool for the number set. The teaching die should be made of hollow plastic and have a size several inches in diameter. This large ball-like shape would not have small parts that could be swallowed by the child, and it could be used as a ball to play with.

There are some situations where it is desired to obtain random numbers within a series, such as the series 0 to 5, which can not be mapped a whole number of times across the faces of an icosahedron. The 0 to 5 series is important to our invention since it could be used in states that use numbers greater than 50 in their lottery series. In this example, the series 0 to 5 can be mapped three times on the 20 faces of an icosahedron, which covers 18 faces. Using this sequence, two of the 20 icosahedron faces remain blank. These two blank faces are imprinted with a non-numeric characters or symbols such as "$", " ", "*", "+", "♥", and "♣". The blank, or "fill", faces could alternatively be imprinted with company logos and these faces are arranged in opposite relationship.

Possible incomplete numbering sequences are shown in the table below:

| Number Series | Number of repetitions on die | Number of blank faces |
|---|---|---|
| 0 to 2(or: 1 to 3) | 6 | 2 |
| 0 to 5(or: 1 to 6) | 3 | 2 |
| 0 to 6(or: 1 to 7) | 2 | 6 |
| 0 to 7(or: 1 to 8) | 2 | 4 |
| 0 to 8(or: 1 to 9) | 2 | 2 |

Figure 31:
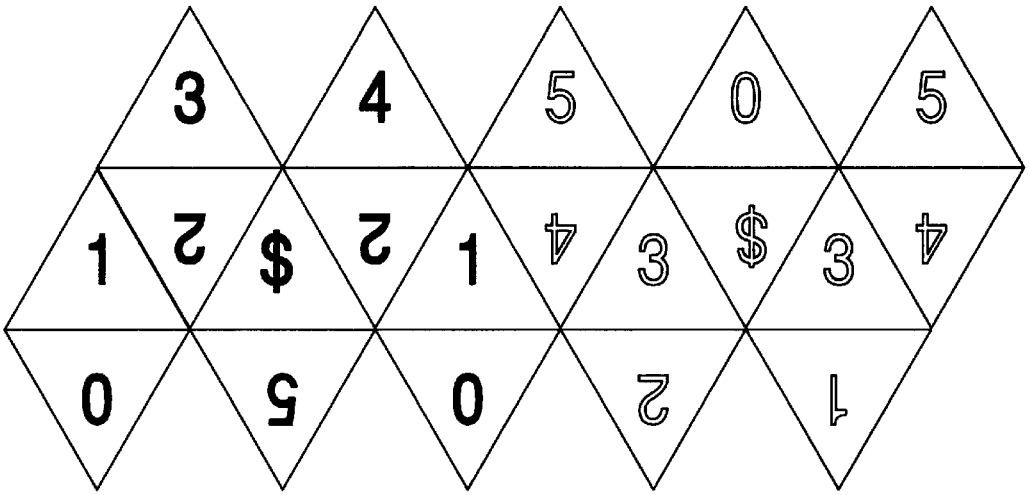
FIG. 31 shows a map view of a 0–5 numbering pattern with two opposed faces imprinted with non-numeric characters.

The preferred embodiment for the 0 to 5 pattern is provided in FIG. 31. The number set 0 to 5 appears three times in this pattern, but the three sets are divided among two large "macro" sets of 10 digits each. In this example, one macro set is printed using a solid font and the second set is printed using outline characters. The fill character, a "$" in this example, appears once in each of the two macro sets. The two macro sets are not completely equal. In the first set the numbers 0, 1, and 2 appear once, and the numbers 3, 4, and 5 appear twice. In the second set the opposite is true; the numbers 0, 1, and 2 appear twice, and the numbers 3, 4, and 5 appear once. Because of the unequal distribution of numbers between the two macro sets, the macro sets can not be used to roll positive and negative numbers with equal probability, so it can not be used in some gaming applications. It is still useful as a method of distinguishing between number sets on the die.

Because the 0 to 5 pattern occurs an odd number of times on the sides of the icosahedron, some of the four rules listed above are violated or modified in the pattern illustrated in FIG. 31.

The first rule, is followed completely; the opposite sides add up to 5. The two fill characters, the "$" signs in this example, are on opposite sides of the die; since they are not numbers, they do not violate Rule 1.

The pattern in FIG. 31 also follows Rule 2. The same numbers do not share a common edge anywhere on the die.

The third rule is followed for the two macro sets; each macro set is grouped together and occupies one half the die.

The fourth rule is followed for the two macro sets; in this example the two macro sets are distinguished from one another by solid and outline font characters.

Figure 32:
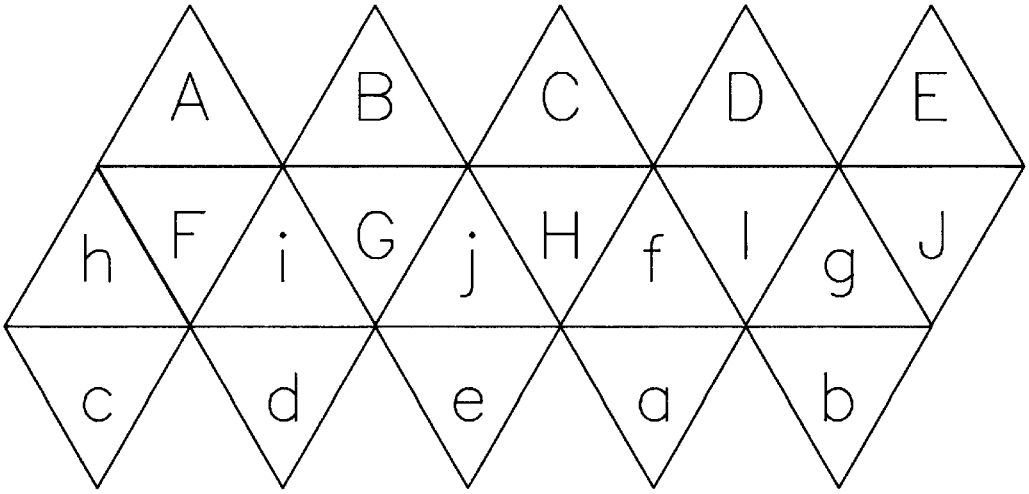
FIG. 32 shows a map view of a non-numeric pattern for an icosahedron decimal die.

FIG. 32 shows a die arrangement similar to that of FIGS. 8, 21–23, 25, 26 and 29 wherein the characters in one group are in the top two horizontal rows and the characters in a second group are in the bottom two horizontal rows. Here the characters in the top group are capital letters and those in the bottom group are lower case letters.

The various patterns of numbers printed on the sides of an icosahedron die, described in previous disclosures, could be replaced by patterns of other symbols. This idea works best for short sets of symbols. Each member of the symbol set could be identified with a number and mapped on the sides of the icosahedron using the appropriate pattern described in our previous disclosures. For example, the math symbols: "+", "−", "×", and "÷". could be imprinted on the sides of one icosahedron die, and the symbols: ">", "<", "≧", "≦", "=" and "≠", could be on the sides of another die. The two math symbols dice, and several icosahedron decimal dice of this invention with numbers on the sides, could be used to teach children math instead of using flash cards.

Other closed sets of symbols may include the following:

| Symbol Set | # in Set |
|---|---|
| Astrological signs | 12 |
| Card Symbols | 4 |
| Letters of the Greek alphabet | 24 |
| Days of the week | 7 |
| Months of the Year | 12 |
| The six primary colors | 6 |
| Birth stones | 12 |
| Astrological planets | 10 |
| Chemical elements | 104 |
| The alphabet | 26 |
| The five senses | 5 |
| Seven deadly sins, or the seven virtues | 7 |

Some of the symbol sets would require fill symbols on some of the sides of the icosahedron; other symbol sets, such as the chemical elements or the alphabet listed above, would require more than one die to contain all the symbols.

There are an unlimited number of open ended sets of symbols that could be imprinted on the sides of an icosahedron die. Possible sets include music symbols, flowers, TV channels, cartoon characters, stock market symbols, cities, states, countries, company logos, and many more.

We claim:

1. A die of uniformly distributed material comprising:

a die body having twenty equal-sided triangular faces arranged to form an icosahedron shape with a plurality of vertexes, each of said vertexes being formed by a conversion of the sides of five triangular faces, said triangular faces being arranged such that each triangular face is spaced from a substantially parallel opposite triangular face, and a plurality of indicia on said die body being formed on said triangular faces, said indicia being arranged in two distinct groups with the indicia in a first group being formed in a first manner and the indicia in a second group being formed in a second manner different from said first manner to visually distinguish said first group from said second group, the indicia formed on any triangular face being in a group which differs from the group which includes the indicia on the opposite substantially parallel triangular face, said plurality of indicia including numbers with the numbers in said first group duplicating the numbers in said second group, the sum of the numbers on each opposite pair of triangular faces on the die body being equal to the same number.

2. The die of claim 1 wherein numbers of the same value are not placed on triangular faces which share a common side.

3. The die of claim 1 wherein said indicia include symbols.

4. The die of claim 1 wherein each said first and second groups of numbers include ten sequential numbers.

5. The die of claim 4 wherein said ten numbers range from 0 to 9.

6. The die of claim 4 wherein the sum of the numbers on each opposite pair of triangular faces is equal to 9.

7. The die of claim 1 wherein the numbers in the first group are imprinted on the die in a different type style than is used for the numbers of the second group.

8. The die of claim 1 wherein the sides of five triangular faces bearing two numbers in one group and three numbers in the remaining group meet at each vertex.

9. The die of claim 1 wherein the numbers of the first group are imprinted on the die as solid line numbers and the numbers in the second group are imprinted on the die in outline form as an outline of each number.

10. The die of claim 1 wherein the numbers of the first group are imprinted on the die in a color different from the numbers in the second group, and wherein both sets of numbers have a color different from the body of the die.

11. A die of uniformly distributed material comprising:

a die body having twenty equal-sided triangular faces arranged to form an icosahedron shape with a plurality of vertexes, each of said vertexes being formed by a conversion of the sides of five triangular faces, said triangular faces being arranged such that each triangular face is spaced from a substantially parallel opposite triangular face, and a plurality of indicia on said die body being formed on said triangular faces, said indicia being arranged in two distinct groups with the indicia in a first group being formed in a first manner and the indicia in a second group being formed in a second manner different from said first manner to visually distinguish said first group from said second group, the indicia formed on any triangular face being in a group which differs from the group which includes the indicia on the opposite substantially parallel triangular face, said indicia including upper case letters in said first group and lower case letters in said second group.

12. A die of uniformly distributed material comprising:

a die body having twenty equal-sided triangular faces arranged to form an icosahedron shape with a plurality of vertexes, each of said vertexes being formed by a conversion of the sides of five triangular faces, said triangular faces being arranged such that each triangular face is spaced from a substantially parallel opposite triangular face, and a plurality of indicia on said die body being formed on said triangular faces, said indicia being arranged in two distinct groups with the indicia in a first group being formed in a first manner and the indicia in a second group being formed in a second manner different from said first manner to visually distinguish said first group from said second group, the indicia formed on any triangular face being in a group which differs from the group which includes the indicia on the opposite substantially parallel triangular face, said plurality of indicia including numbers with the numbers in said first group duplicating the numbers in said second group, each of said first and second groups of numbers including two subgroups apiece of five continuous numbers in each subgroup, wherein each subgroup has the same five continuous numbers.

13. The die of claim 12 wherein each subgroup contains the numbers 0 through 4.

14. The die of claim 13 wherein said triangular faces are flat faces, said triangular faces being arranged such that each face is spaced from a substantially parallel opposite face, and wherein the number value imprinted on any face of the die when added to the number imprinted on the opposite face is equal to four.

15. The die of claim 14 wherein the triangular faces of the die, if arranged in a flat plane form four horizontal rows of five triangles each, the triangles in each row being identically oriented, said first group of numbers being imprinted on the top two rows of triangles, and said second group of numbers being imprinted on the bottom two rows of triangles.

16. A random number generating system comprising:

at least a first and a second die each having a die body, the die body of said first die being colored a first color and the die body of said second die being colored a second color which is different and visually distinct from said first color, each said first and second die including a die body having twenty equal-sided triangular faces arranged to form an icosahedron shape with a plurality of vertexes, each of said vertexes being formed by a conversion of the sides of five triangular faces; the triangular faces of each said die being flat faces, said triangular faces being arranged so that each face is spaced from a substantially parallel opposite face such that when a die is rolled and comes to rest on a face, the opposite face becomes a top face of the die, a plurality of numbers forming indicia on said die body with one number being the only indicia appearing on each triangular face;

said numbers being formed in a color which is visually distinct from the color of said die body and being arranged in two distinct groups each having a plurality of numbers with the numbers of a first group duplicating the numbers of a second group;

the numbers of said first group being formed differently from the numbers of said second group to visually distinguish said first group from said second group, and wherein the numbers appearing on the top faces of said first and second dice, after said first and second dice are rolled, are to be read in a specific order to form a number sequence, said order being determined by the color of each die body.

17. The random number generating system of claim 16 wherein the number formed on any triangular face of said first and second dice is in a group which differs from the group which includes the number on the opposite substantially parallel triangular face.

18. The random number generating system of claim 17 wherein the numbers in the first group of each die are imprinted on the die in a first number color which is different and visually distinct from the color of the die body and the numbers in said second group of each die are printed on the die in a second number color which is different and visually distinct from both said first number color and the color of said die body.

19. The random number generating system of claim 18 which includes at least a third die having a die body colored a third color which is different and visually distinct from said first and second colors.

20. The random number generating system of claim 17 wherein said system is comprised of two icosahedron dice, each die body having a different color from each other, wherein the first die has the sequence of numbers from 0 to 4 repeated four times on the faces of the die, and whereas the second die has the sequence of numbers 0 to 9 repeated two times on the faces of the die, such that the two dice when read in their designated sequence form two decimal digits having the combined decimal number value randomly appearing within the range 00 to 49.

21. The random number generating system of claim 17 wherein said system is comprised of a number "n" of icosahedron dice, where n is two or more, each die body having a different color from the others in the set, wherein all dice in the set have the sequence of numbers from 0 to 9 repeated two times on their faces, such that the dice when read in their designated sequence, form the digits of a decimal number, n digits in length, having the combined decimal number value randomly appearing within the range 0 . . . 0 to 9 . . . 9.

22. The die of claim 2 wherein each of said first and second groups include two or more subgroups of numbers.

23. The die of claim 22 wherein the numbers in each subgroup are continuous and sequential.

24. The die of claim 23 wherein there are ten subgroups of two numbers each.

25. The die of claim 24 wherein each subgroup includes the numbers 0 and 1.

26. A die of uniformly distributed material comprising:

a die body having twenty equal-sided triangular faces arranged to form an icosahedron shape with a plurality of vertexes, each of said vertexes being formed by a conversion of the sides of five triangular faces, said triangular faces being arranged such that each triangular face is spaced from a substantially parallel opposite triangular face, a plurality of numbers formed on said die body with one number being formed on each triangular face, said numbers being arranged in two distinct groups with the numbers in a first group being formed in a first manner and the numbers in a second group being formed in a second manner different from said first manner to visually distinguish said first group from said second group, the sum of the numbers on each opposite pair of triangular faces on the die body being equal to the same number.

27. The die of claim 26 wherein numbers of the same value are not placed on triangular faces which share a common side.

* * * * *